US005118000A

United States Patent [19]

Howell et al.

[11] Patent Number: 5,118,000

[45] Date of Patent: Jun. 2, 1992

[54] LID LOCK

[75] Inventors: Billy E. Howell, Middlebury, Ind.; Steven A. Brown, Three Rivers, Mich.

[73] Assignee: Leland Engineering, Inc., White Pigeon, Mich.

[21] Appl. No.: 772,271

[22] Filed: Oct. 7, 1991

[51] Int. Cl.[5] ..... B65D 45/00

[52] U.S. Cl. ..... 220/315; 220/322; 220/908; 414/407; 414/414

[58] Field of Search ..... 220/210, 262, 263, 264, 220/315, 322, 908; 414/407, 414

[56] References Cited

U.S. PATENT DOCUMENTS 4,155,584 5/1979 Pracchia ..... 294/73
4,182,530 1/1980 Hodge ..... 294/73
5,015,021 5/1991 Wyson et al. ..... 292/230
5,029,724 7/1991 Serio ..... 220/322
5,042,856 8/1991 Goodman ..... 292/259 R

*Primary Examiner*—Stephen Marcus
*Assistant Examiner*—Nova S. Sucker
*Attorney, Agent, or Firm*—James D. Hall

[57] ABSTRACT

A locking mechanism having a latch and linkage system that automatically unlocks the lid on trash bins when the trash bin is lifted into the air and then automatically re-locks the lid when the trash bin is placed back on the ground. A leg and pod assembly is attached to the linkage system and pulls the linkage system pivotably downward to move the latch away from the lid when the bin is lifted and thereafter pushes the linkage system upward to pivotably move the latch to secure the lid when the bin is repositioned.

8 Claims, 4 Drawing Sheets

LID LOCK

FIELD OF THE INVENTION

This invention is related to the lid on trash bins that are lifted by trash trucks and emptied into the truck's trash collector.

Due to the advent of recycling, many trash bins have been designated for use of only certain form of trash. The lids on these trash bins are locked so that unauthorized personnel can not put impermissible trash into the trash bins. However, when the trash bin needs to be emptied into the trash collector of a truck, either the bin will have to be unlocked for the driver of the truck or the driver will have to get out of the truck to unlock the lid to allow the lid to be opened. Often, the driver may not have a key or similar device to open the lid lock and thus will have to seek out the key or someone to unlock the lid, wasting considerable time. This invention allows the lid to be automatically released for opening during the dumping operation.

SUMMARY OF THE INVENTION

This invention utilizes a linkage mechanism which is attached to a lid latch for the trash bin. The linkage mechanism is connected to a pod device which rests upon the same supporting surface as the bin. When the trash bin is resting upon its supporting surface, the latch locks the lid into its closed position due to the pod engagement with the surface. However, when the trash bin is lifted for dumping, the latch is shifted as the pod device leaves the supporting surface to unlock the lid. When the trash bin is placed on the supporting surface, the latch secures the lid again in its closed position. The latch may be manually released to allow opening of the lid with the bin remaining in its supporting surface.

Hence, it is an object of this invention to provide a locking mechanism in trash bins that automatically unlocks the lid on trash bins when the trash bin is lifted into the air for dumping and then automatically locks the lid when the trash bin is placed back to its original position.

It is another object of the present invention to include a convenient and economical locking mechanism for lids on trash bins or similar receptacles.

Other objects will become apparent upon a reading of the following description.

DETAILED DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use so that others skilled in the art may follow its teachings.

Figure 1:
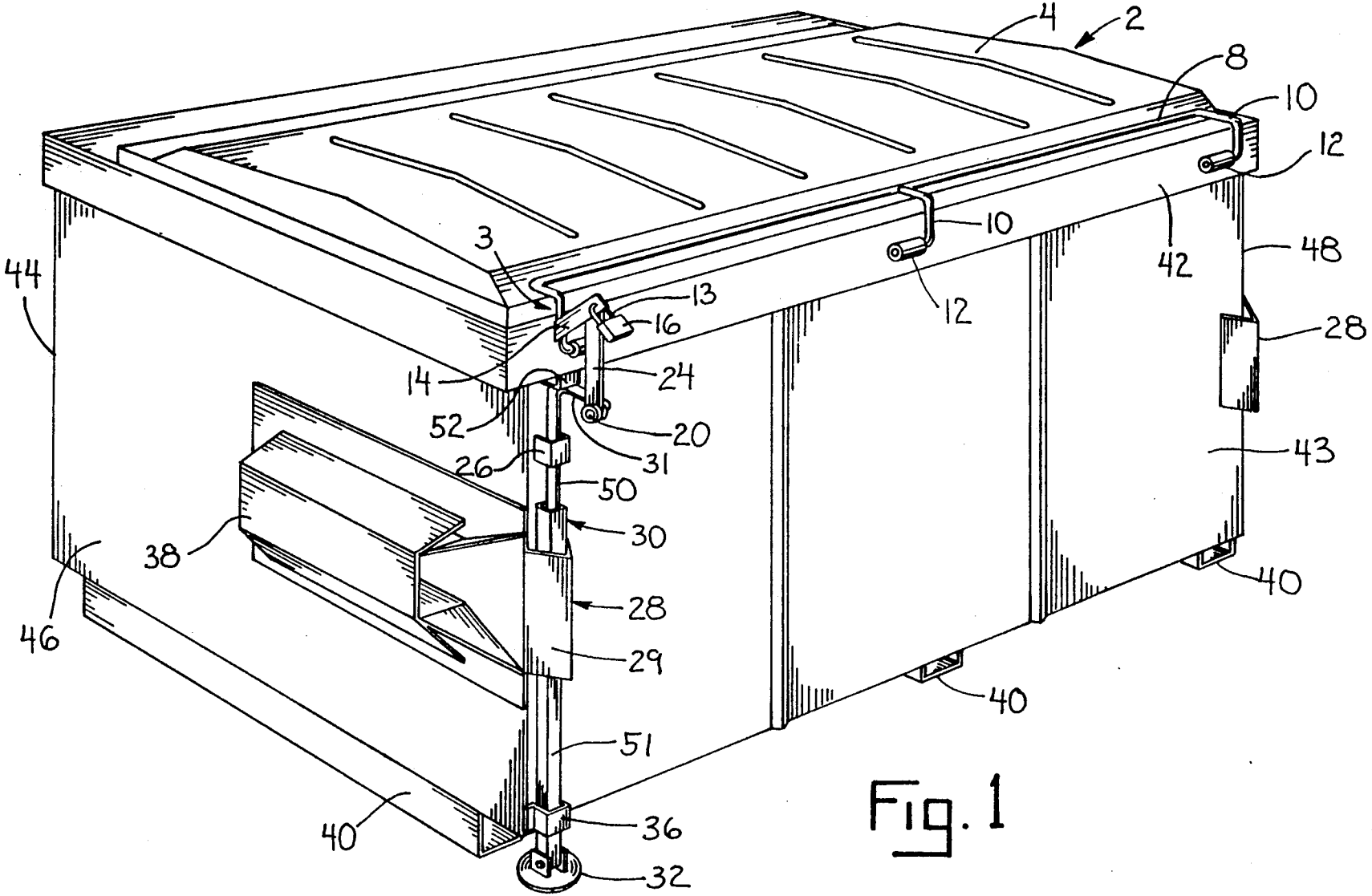
FIG. 1 is a front perspective view of the trash bin and lid lock showing the lid in its locked position.
Figure 2:
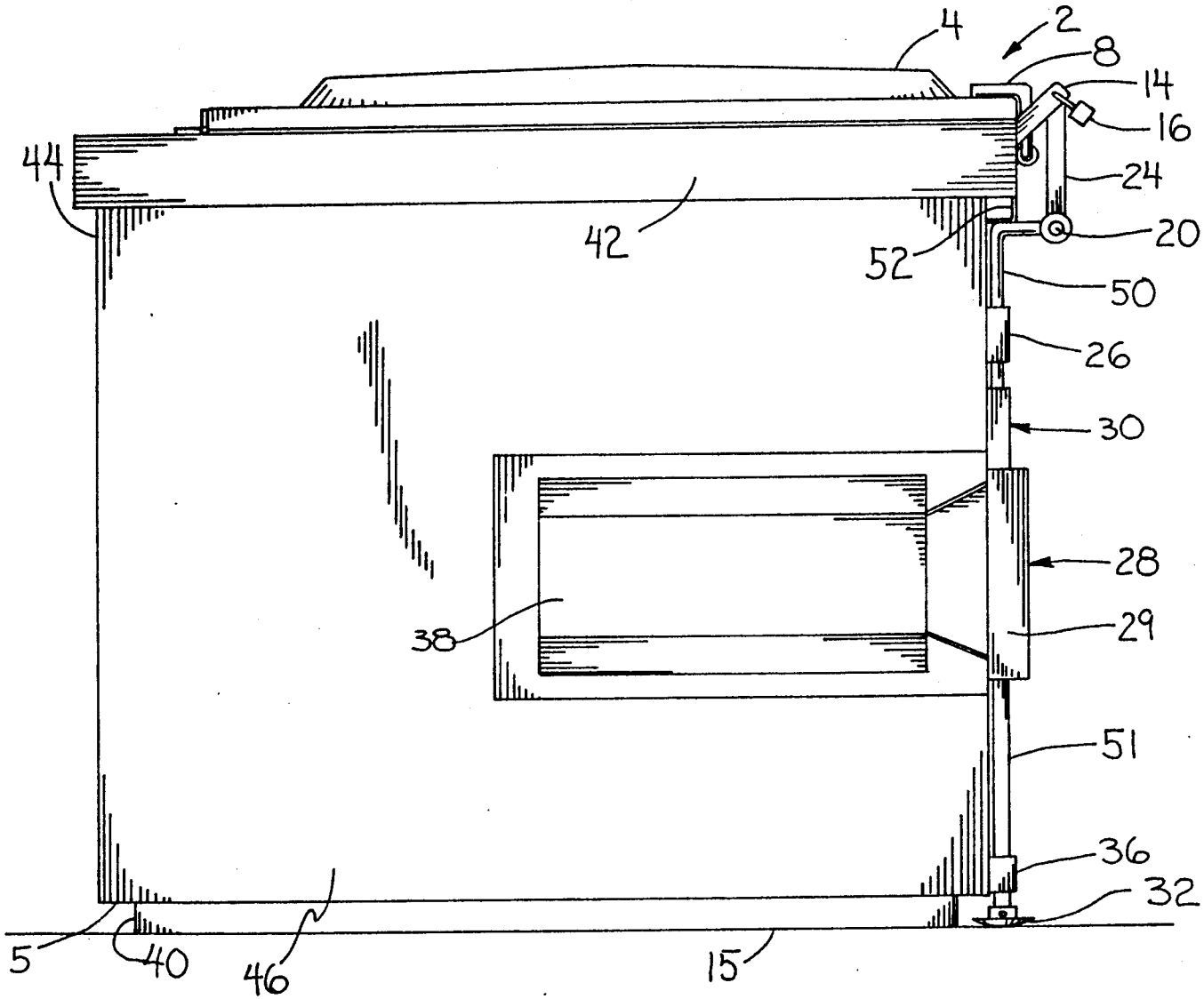
FIG. 2 is a left side view of FIG. 1.

Referring to the drawings. FIGS. 1 and 2 show the locking mechanism 3 installed on a trash bin 2 with the trash bin placed on its supporting surface 15 in its normal position. Trash bin 2 has a front wall 43, back wall 44, left side wall 46, right side wall 48 and an integral bottom wall 5. An upper lip 42 extends peripherally around the trash bin at its open top. A lid 4 is hinged to the lip 42 of the trash bin 2, allowing the lid 4 to be pivotally movable between open and closed positions. A latch 8 extends along lip 42 at bin front wall 43. Latch 8 includes inturned pintels 10 each journalled in a sleeve 12 welded to lip 42 of the trash bin 2. This allows latch 8 to be pivoted between secured and unsecured positions with respect to the lid 4.

A fixed linking arm 14 extending diagonally upward when latch 8 is in its secured position is welded at one end to the latch. A pivoting link 24 extends downwardly from the other end of the fixed linking arm 14. Aligned holes are formed in the overlapping portions of link 24 and arm 14 to allow the insertion of the bowed bar 13 of a padlock 16. The lower end of the pivoting link 24 is secured by pin 20 to the outturned part 31 of a leg 30. Leg 30 includes an upper bar section 50 and an integral lower section 51 retained against lateral displacement by collars 26 and 36. Collars 26 and 36 are secured to front wall 43 of the bin, near one corner. A pod 32 is pivotally secured to the lower end of leg 30. Leg 30 is shiftable vertically relative to bin 2 within collars 26, 36. A stop member 52 is secured underneath an overhanging portion of the lip 42 for engaging leg 30 when pod 32 is at the same approximate level of the lowermost surfaces of supports 40 secured to the bottom wall 5 of the bin.

A hollow V-shaped bumper 28 is secured along the bin front wall 43 at the junction of each side wall 46, 48 in front of a forklift holder 38. Each bumper 28 has a bevelled edge 29 that guides the forklift into the holder 38. Leg 30 extends with clearance through bumper 28.

In operation, FIGS. 1 and 2 show trash bin 2 resting on a supporting surface 15 with the lid 4 in its closed position locked by the latch 8 in its secured position. Leg 30 in contacting stop member 52 when pod 32 is approximately level with supports 40 prevents overstressing of latch 8 and bending of arm 14 and link 24. The padlock 16 locks the fixed linking arm and pivoting link together to retain latch 8 in its lid overlapping, secured position. With the leg 30 and pod 32 assembly being prevented from downward movement relative to bin 2 due to the pod resting upon supporting surface 15. The fixed linking arm 14 is also prevented from moving downward and hence prevents the latch 8 from pivoting to its unsecured position.

Figure 4:
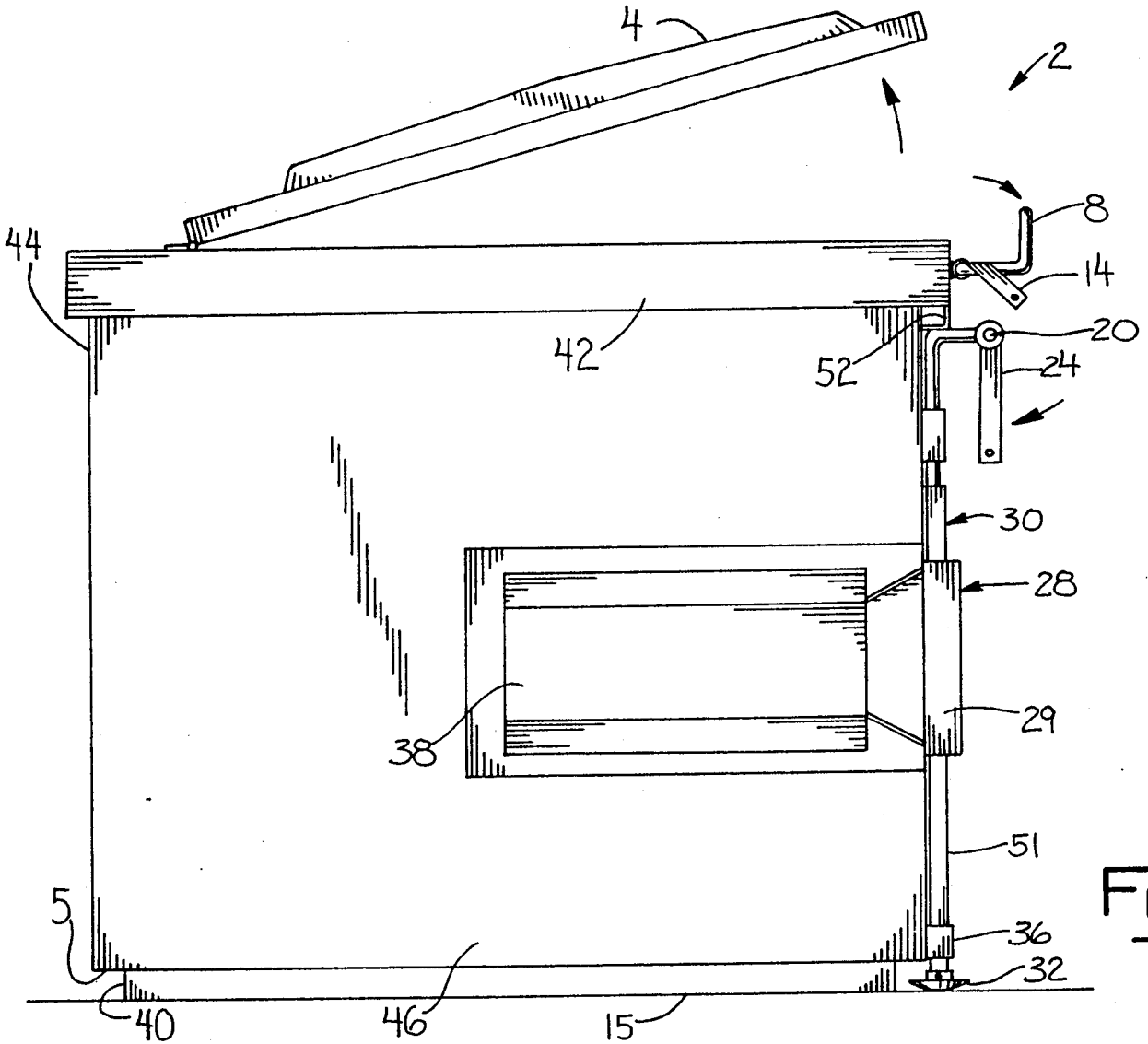
FIG. 4 is a left side view of the trash bin like FIG. 2 but with it lid lock opened.

FIG. 4 shows the manner in which the lid 4 can be opened by removing padlock 16 which frees link 24 to allow latch 8 to be pivoted into its unsecured position with the bin resting upon supporting surface 15. To secure lid 4, latch 8 is pivoted back into its secured position over the lid and arm 14 and link 24 reconnected by padlock 16.

Figure 3:
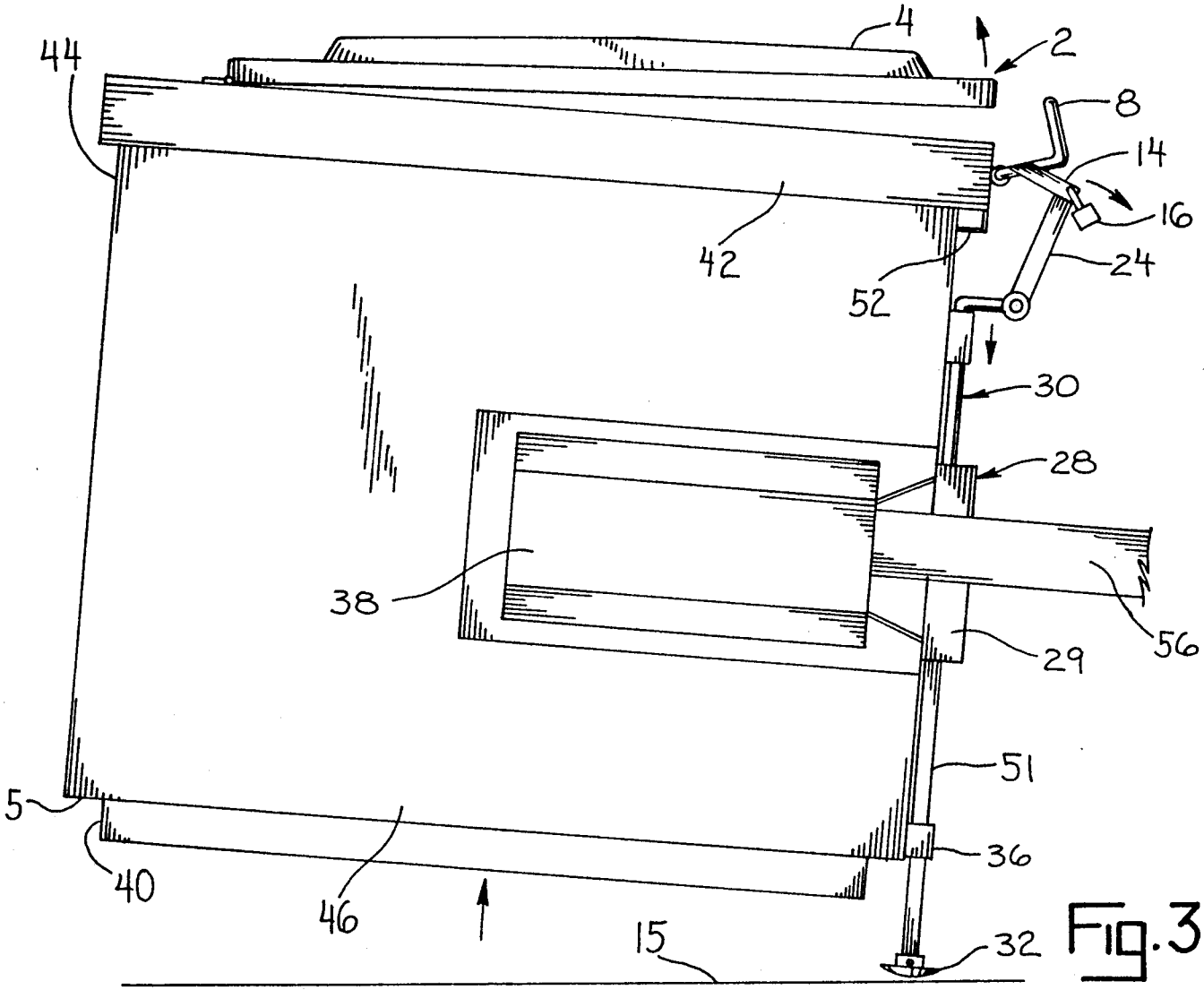
FIG. 3 is a left side view of the trash bin showing the bin lifted and the lid in its unlocked position.

FIG. 3 shows the trash bin 2 being lifted up by a dump truck with its forklift 56 inserted in each forklift holder 38. As the bin 2 is lifted from supporting surface 15, the weight of the leg 30 and its pod 32 cause the leg to shift vertically relative to collars 26, 36 and bumper 28 which pulls link 24 and connected arm 14 downwardly to move latch 8 pivotally away from the lid 4 into its unsecured position. This frees lid 4 which pivots into its open position as the bin is inverted and emptied into the trash collector of the truck.

After the trash is emptied, the trash bin 2 is then placed back down on the ground by the truck with lid 4 pivoting by gravity into its closed position As the trash bin 2 is repositioned upon supporting surface 15, pod 32 in contacting surface 15 pushes leg 30 upwardly relative to the bin causing pivoting link 24 to push fixed linking arm 4 upwardly which inturn pivotally moves the latch 8 into its secured position overlying lid 14. Lid 4 is now re-locked in its closed position shown in FIG. 1.

It is understood that the above description does not limit the invention to the given details, but may be modified within the scope of the following claims.

I claim:

1. In combination, a container including a lid and a locking mechanism, said locking mechanism used for securing said lid in a closed position on said container, said locking mechanism carried by said container and including means for automatically releasing said lid when said container is lifted from a supporting surface to permit said lid to shift from its said closed position into an open position.

2. The combination of claim 1 wherein said locking mechanism includes a latch engaging said lid when in its said closed position, said latch having a secured position and an unsecured position, actuating means connected to said latch for shifting said latch between its said secured position for securing the lid in the lid's said closed position and its said unsecured position to allow the lid to shift into the lid's said open position, said actuating means being movable relative to said container and adapted to contact said supporting surface for shifting said latch into its said secured position to maintain said lid in the lid's said closed position when said container is placed upon said supporting surface.

3. The combination of claim 2 and including locking means in association with said actuating means for operatively connecting the actuating means to said latch, said locking means being releasable to operatively disconnect said actuating means from said latch when said container is in place upon said supporting surface to allow said latch to be shifted to said unsecured position.

4. The combination of claim 2 wherein said actuating means includes linkage means and a leg having a lower end and an upper end, and said linkage means being connected between said latch and said upper end of the leg.

5. The combination of claim 4 and including removable locking means interconnecting said linkage means for allowing the disconnection of at least a part of the linkage means from associated connection with said latch to allow the latch to be shifted from its said secured position to its said unsecured position upon removal of the locking means with said container placed upon said supporting surface.

6. The combination of claim 4 wherein said linkage means includes an arm and a link, said upper end of said leg connected to said link, and said arm attached to said latch, said arm and link connected by said locking means.

7. The combination of claim 6 wherein said locking means is a padlock.

8. The combination of claim 6 wherein said leg includes a pod at said lower end of said leg.

* * * * *